US005470162A

United States Patent [19]

Rubin

[11] Patent Number: 5,470,162

[45] Date of Patent: Nov. 28, 1995

[54] ERGONOMIC HAND-HELD IMPLEMENT

[76] Inventor: Burton S. Rubin, 200 E. 33rd St., Apt. 28-D, New York, N.Y. 10016

[21] Appl. No.: 193,635

[22] Filed: Feb. 8, 1994

Related U.S. Application Data

[63] Continuation of Ser. No. 906,855, Jun. 30, 1992, abandoned.

[51] Int. Cl.[6] ..... B43K 23/00; B43K 19/00

[52] U.S. Cl. ..... 401/6; 15/443; 401/7; 401/88; D19/41

[58] Field of Search ..... 401/6, 7, 88; 15/443; D19/41

[56] References Cited

U.S. PATENT DOCUMENTS

| | | | |
|---|---|---|---|
| D. 43,242 | 11/1912 | Bernstein | D19/41 |
| D. 292,104 | 9/1987 | Keller, Jr. | D19/55 |
| D. 292,297 | 10/1987 | Bingham | D19/41 |
| 336,644 | 2/1886 | Hollwede | 401/88 X |
| 825,985 | 7/1906 | Schwertenberg | 401/6 |
| 1,188,394 | 6/1916 | Bernstein | 401/225 |
| 1,438,114 | 12/1922 | Hume | 401/6 |
| 1,459,517 | 6/1923 | Sawyier | 15/443 |
| 1,678,505 | 7/1928 | Gregory . | |
| 3,947,977 | 4/1976 | Bishop | 401/6 X |
| 3,994,605 | 11/1976 | McKnight | 401/6 X |
| 4,035,865 | 7/1977 | McRae et al. . | |
| 4,037,975 | 7/1977 | Huffman | 401/6 |
| 4,302,121 | 11/1981 | Kim . | |
| 4,588,317 | 5/1986 | Taylor . | |
| 4,832,604 | 5/1989 | Rusk . | |

FOREIGN PATENT DOCUMENTS

| | | | |
|---|---|---|---|
| 39911 | 9/1973 | Australia . | |
| 56958 | 11/1939 | Denmark | 15/443 |
| 359100 | 8/1921 | Germany | 401/6 |
| 2729749 | 1/1979 | Germany . | |
| 9562 | of 1895 | United Kingdom | 15/443 |
| 1340389 | 12/1973 | United Kingdom | 401/6 |

*Primary Examiner*—Steven A. Bratlie
*Attorney, Agent, or Firm*—Merchant, Gould, Smith, Edell, Welter & Schmidt

[57] ABSTRACT

A hand-held implement which is sufficiently small so that it does not extend beyond the hand of the user and has forward and side surfaces which are oriented so that the implement in use extends in a direction which is no further toward the thumb of the user than the index finger of the user. The forward and side surfaces can be provided with concave contours which engage the thumb and fingers of the user.

4 Claims, 3 Drawing Sheets

ERGONOMIC HAND-HELD IMPLEMENT

This application is a continuation of U.S. application Ser. No. 07/906,855 filed Jun. 30, 1992, now abandoned.

BACKGROUND OF THE INVENTION

The present invention is directed to an implement which is held in one's hand and used in manual activities. Examples of such implements include writing implements such a pens and pencils, cutting implements which contain a blade for cutting, paint brushes, cosmetics applicators and various other implements such as soldering devices, a computer stylus, etc.

In the past, such devices have generally been provided with a cylindrical shaft which is manipulated primarily by the thumb and index finger of the user, with the device contacting relatively small surfaces of the thumb and fingers. This type of device is configured so that in use the device extends in the direction between the thumb and index finger. This orientation of such implements can be considered to date back to times when feather quills were used for writing implements. Thus, the shape of the feather has governed the basic concept of the configuration of hand-held implements. However, a fundamental disadvantage for implements based upon the configuration of the feather is that the cylindrical shaft does not conform well to the surfaces of the fingers, palm and inner hand which should control the implement. This can lead to discomfort over prolonged periods of use, as the rigid surfaces of the implement create pressure points and sources for friction on the fingers. Because such implements contact a relatively small surface of the fingers, large areas of the thumb and fingers are unused and the contribution of the hand in using such hand-held implements is relatively small.

Some attempts have been made to modify hand-held implements to reduce discomfort and fatigue. For example, implements have been produced having soft rubber coating materials. However, such materials tend to reduce the control of the implement in the hand. Also, it has been proposed to provide hand-held implements with different concave surfaces. However, these surfaces have not overcome the basic problems arising from the basic idea of a cylindrical shaft oriented to extend in a direction between the thumb and index finger of the user and out of the hand.

SUMMARY OF THE INVENTION

It is an object of the present invention to provide a hand-held implement which provides high precision for performing a manual activity while simultaneously providing a high degree of comfort during prolonged use.

A further object of the invention is to provide a hand-held implement which can be held for longer periods of time with reduced fatigue of the hand.

A further object of the invention is to provide a hand-held implement which provides less friction and pressure on contact surfaces of the hand, thereby reducing the development of calluses on the hand, for example, along the third finger.

A still further object of the present invention is to provide a hand-held implement which is of a smaller size, but which provides a greater proportion of surface in contact with the hand, thus enabling greater control of the implement with increased comfort.

The above objects and others are accomplished by providing a hand-held implement which has a bottom portion from which a tool extends, e.g., a pen or pencil point, a forward surface extending upwards from the bottom portion, and first and second side surfaces extending upward from the bottom surface and rearward from the front surface. The forward surface is adapted to be engaged by the index finger of the user, and the surfaces are oriented so that in use the implement extends in a direction which is no further toward the user's thumb than the user's index finger. The implement is of sufficient size so that the implement fits comfortably in the palm and does not extend outside the palm of the user.

BRIEF DESCRIPTION OF THE DRAWINGS

The present invention will now be described with reference to the accompanying drawings, in which.

DESCRIPTION OF THE INVENTION

Figure 2:
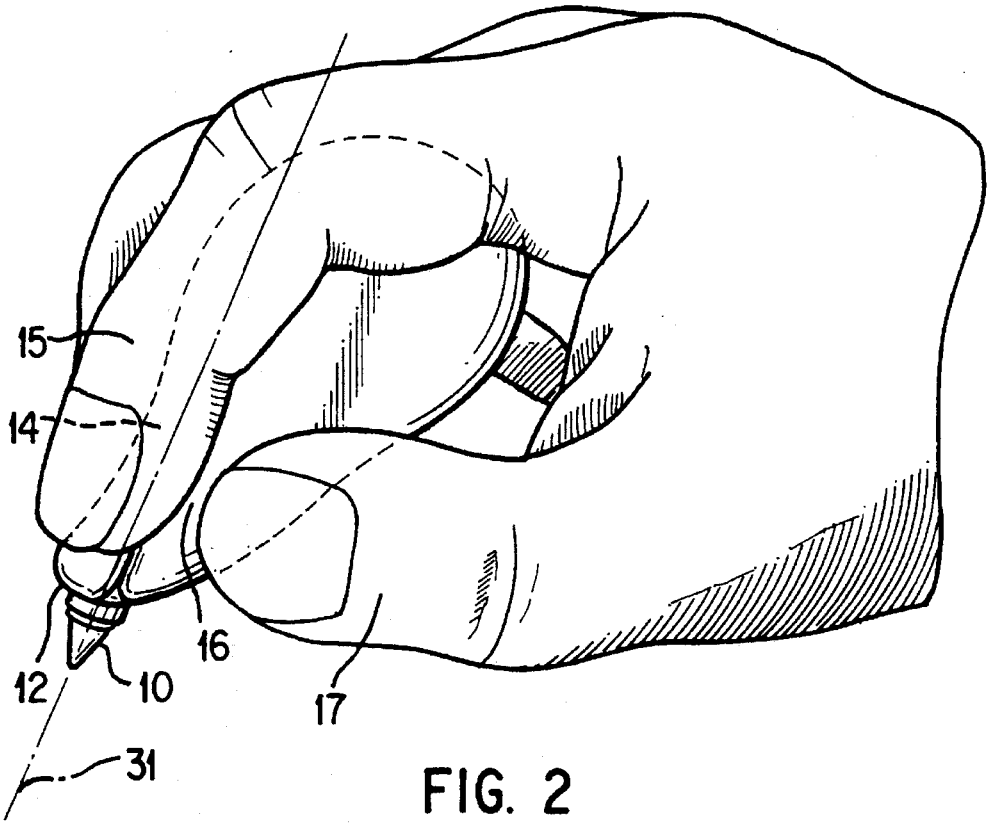
FIG. 2 shows the implement as held in a hand.
Figure 1:
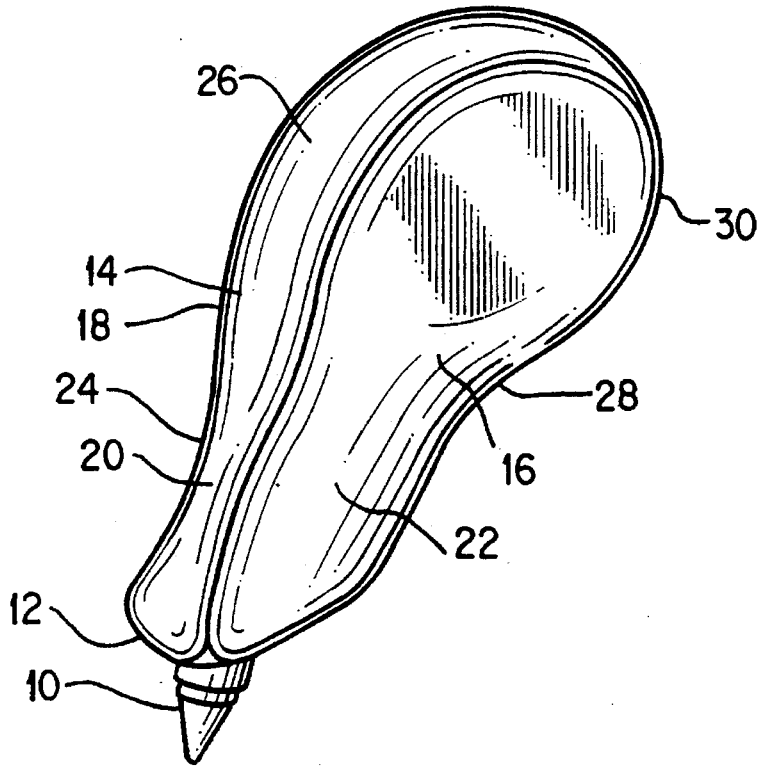
FIG. 1 shows a perspective view of the hand-held implement of the present invention.
Figure 4:
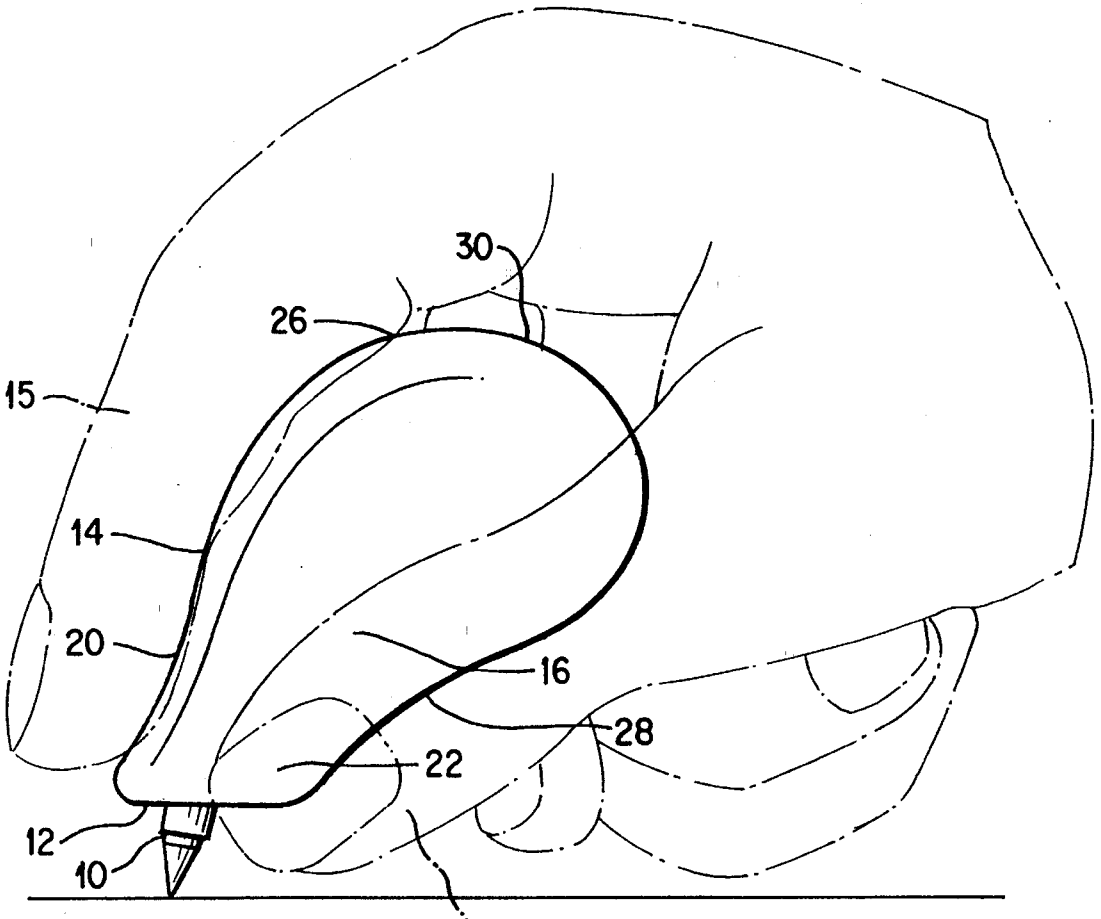
FIG. 4 shows a side view of the implement held in a hand.
Figure 3:
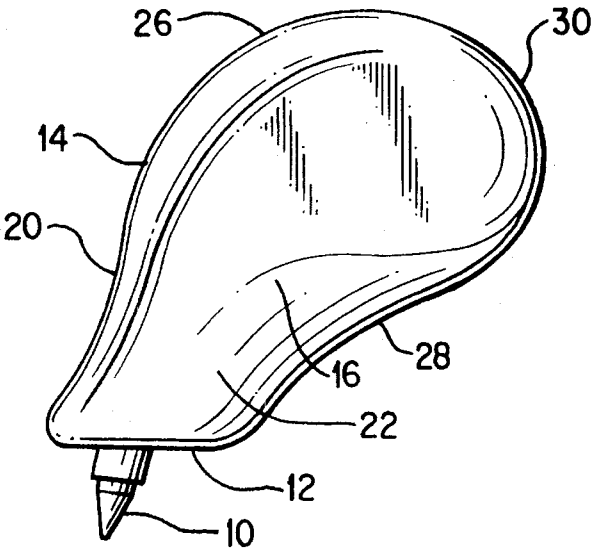
FIG. 3 shows a side view of the implement of FIG. 1.

Referring to the figures, it can be seen that the hand-held implement of the present invention is used to carry a tool 10. In the illustrated embodiment, tool 10 is a ball point pen. However, the tool can be any one of a variety of devices which require precise manual control. Examples include other writing implements such as pencils and fountain pens, the blade for a cutting implement, a brush for painting, a brush or puff for cosmetic application, a soldering tip or a contacting device such as a computer stylus. The tool extends from the bottom portion 12 of the implement. Extending upward from the bottom portion 12 is a forward surface 14 and first and second side surfaces 16 and 18, respectively. The side surfaces 16 and 18 extend rearward from the forward surface 14. As seen in FIGS. 2 and 4, in use, the forward surface is engaged by the index finger 15 of the user, the first side surface 16 is engaged by the thumb 17 of the user and the second side surface 18 is engaged by the third finger of the user.

The forward surface 14 is provided with a concave contour 20 adjacent the bottom portion 12. Similarly, the side surfaces 16 and 18 are provided with concave contours 22 and 24 adjacent the bottom portion. The concave contours are smooth and gradual, without sharp edges. Similarly, the surfaces of the implement are joined smoothly, with rounded edges. These features increase the comfort of the implement in use.

The forward surface 14 also includes a convex contour 26 extending from the concave contour 20. Again, the two portions are joined smoothly.

The implement is provided with a rearward surface 28. This surface is provided with a concave contour adjacent the bottom portion which is joined to the convex contour of the forward surface by a second convex contour 30. Again, contours 26, 28 and 30 are joined smoothly. The concave contour of the rearward surface 28 results in the implement having a reduced size in the area of the concave contours 20, 22 and 24. This permits the comfortable positioning of the third finger of the user during use, with the side of the third finger of the user engaging the concave contour 24 in the area of the end or middle joint of the finger. The convex contours 26 and 30 provide a somewhat bulbous upper portion which provides a feeling of security when the implement is held in the hand.

Figure 6:
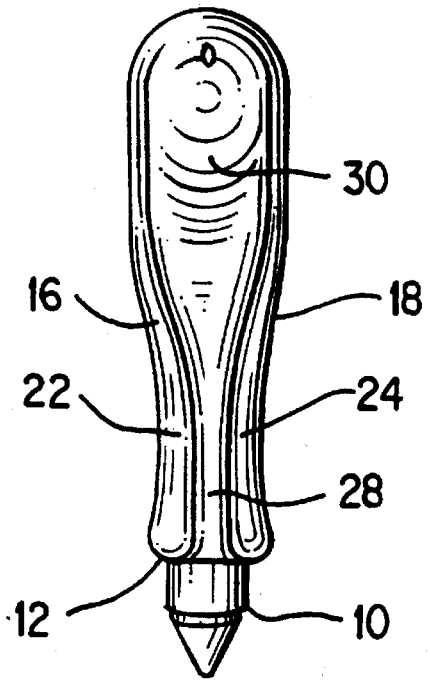
FIG. 6 shows a rear view of the implement of FIG. 1.
Figure 5:
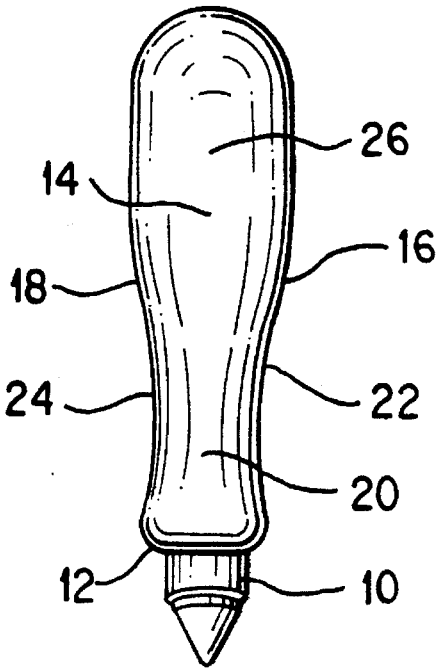
FIG. 5 shows the front view of the implement of FIG. 1.

Additionally, as seen particularly in FIG. 6, the width of the implement decreases in the direction of the rearward surface, particularly in the area of the concave contours 20, 22 and 24. This taper provides increased comfort and control.

Referring again to FIGS. 2 and 4, it can be seen that, in use, the index finger of the user 15 extends along the forward surface 14 of the implement. Thus, the present invention in use permits the hand of the user to assume a comfortable arched configuration, with the implement being substantially co-planar with the arch defined by the index finger and corresponding portion of the palm of the user. The implement is of a sufficiently small length that it does not extend beyond the hand of the user, but rather fits within the user's hand. The bulbous upper portion extends well into the interior of the palm, with the area of convex contour 30 contacting the palm, particularly between the base of the user's index finger and the base of the thumb. When the user's hand is curled to grasp the instrument, the flesh between the thumb and fingers deforms quite readily and can comfortably accept the bulbous upper portion of the implement.

The surfaces 12, 14 and 16 are oriented so that the implement in use will extend in a direction which is preferably essentially parallel to the user's index finger, but in any event, a direction which is no further toward the thumb of the user than the index finger. Thus, instead of extending in the direction of the user's thumb or the space between the thumb and index finger, the index finger defines the limit on the direction in which the implement extends with respect to the thumb. This relationship can also be conceptualized by considering the tool 10 as defining a longitudinal axis, which is identified by numeral 31 in FIG. 2. The longitudinal axis 31 is preferably substantially parallel to the index finger of the user, but in any event is not oriented outside of the index finger in the direction of the thumb.

The implement can be of any suitable dimensions consistent with the above relationships. For example, the distance between the forward and rearward surfaces along the bottom portion can be about one inch (2.5 cm), the width of the forward surface at the bottom portion can be about three eights of an inch (1 cm), and the length of the implement, excluding the tool, can be about two and a quarter inches (5.5 cm). Different sizes can be used to accommodate different sizes of hands.

The implement of the present invention can be made of any material suitable for the intended purpose of the implement. Examples include various polymeric materials, metal, wood and glass. It should also be noted that the side surfaces 16 and 18, in the bulbous upper portion of the device, provide a relatively smooth surface which is well-suited for application of art work, logos, advertising, etc.

While a detailed description of the present invention has been provided above, the present invention is not limited thereto, but rather is defined by the following claims.

What is claimed is:

1. A hand-held implement, comprising:

a bottom portion from which a tool extends;

a forward surface extending upward from the bottom portion, having a smooth first concave contour, the forward surface being adapted to be engaged by and extend in a direction substantially parallel to the index finger of a user;

first and second opposed side surfaces extending upward from the bottom portion and rearward from the forward surface, said first and second side surfaces being provided with opposed smooth concave contours, the concave contour of one of the side surfaces being adapted to engage the thumb of a user, the concave contour of the other of the side surfaces being adapted to engage the side of a third finger of a user, the first concave contour and the concave contours of the side surface being adjacent the bottom portion, the forward and side surfaces being oriented so that in use the forward surface is substantially parallel to the user's index finger;

a rearward surface comprising a second concave contour, the concave contours of said first and second side surfaces extending between said first and second concave contours; and a first convex contour smoothly joining said forward surface and said rearward surface, said second concave contour being smoothly joined to said first convex contour, the first convex contour being adapted to fit within the palm of a user, the forward surface, the first and second side surfaces and the first convex contour defining a bulbous upper portion above the concave contours of the side surfaces.

2. The implement of claim 1, wherein the forward surface comprises a second convex contour extending between the first convex contour and the first concave contour.

3. The implement of claim 1, wherein the tool is a pen or pencil.

4. The implement of claim 1, wherein the width of the implement decreases from the forward surface to the rearward surface along the concave contours of the side surfaces.

* * * * *